United States Patent [19]

Henning

[11] 4,172,484

[45] Oct. 30, 1979

[54] GOLF BAG

[76] Inventor: Luther T. Henning, 1579 Bridle Path Dr., Lansdale, Pa. 19446

[21] Appl. No.: 922,967

[22] Filed: Jul. 10, 1978

[51] Int. Cl.[2] ..... A63B 55/04

[52] U.S. Cl. ..... 150/1.5 B; 150/1.5 R; 248/96

[58] Field of Search ..... 150/1.5 R, 1.5 B, 1.5 C; 220/21; 248/96, 156

[56] References Cited

U.S. PATENT DOCUMENTS

| | | | |
|---|---|---|---|
| 1,659,269 | 2/1928 | Hotze | 150/1.5 R |
| 1,798,638 | 3/1931 | Stone | 150/1.5 R |
| 3,363,802 | 1/1968 | Cornelius | 220/21 X |
| 3,593,766 | 7/1971 | Harmon | 150/1.5 R X |
| 3,603,540 | 9/1971 | Gouge | 248/96 |

*Primary Examiner*—Donald F. Norton

*Attorney, Agent, or Firm*—Joseph W. Molaskey & Associates

[57] ABSTRACT

A golf bag is constructed to be compact and light in weight and to hold a full set of fourteen clubs. The bag comprises a plurality of compartments provided by a honeycomb-shaped framework of a cloth-like material. The bag also comprises a spike insertable into the ground to hold the bag in an upright position.

10 Claims, 6 Drawing Figures

GOLF BAG

BACKGROUND AND SUMMARY OF THE INVENTION

One type of golf bag in general use today, known as a "Pro" bag, tends to be large and heavy and designed for holding a large amount of equipment only usable by a provisional golfer. An alternative to this large bag is the "Sunday bag" which does not hold a full set of clubs. Other gold club holding devices, such as canes or handles, are usually restricted to less than a full set of clubs and cannot carry any substantial additional equipment.

Accordingly, there is a need for a golf bag that is compact and light in weight and capable of holding a full set of clubs and it is the general object of this invention to provide such a golf bag. To this end, the golf bag of the invention is comprised of a shell defining an elongated enclosure for receiving and holding the shafts of golf clubs, and means within the enclosure providing a plurality of separate compartments for receiving and holding golf club shafts in a predetermined separated position in the bag, the compartment providing means including a honeycomb-shaped divider means providing a plurality of separate compartments having an open top ends through which the golf club shafts may be inserted into the enclosure. More specifically, the divider means comprises a framework of a cloth-like material constructed and arranged to define a plurality of hexagonal-shaped compartments extending the length of the golf bag.

The golf bag of the invention thus comprises separate compartments constructed to provide strength to the bag and protection for the clubs. The design of the invention avoids the congestion that occurs in small bags when clubs are shoved into a confined area. The honeycomb construction in accordance with the invention permits a compact stacking arrangement wherein, if desired, each club can be made available to the golfer at all times in the same location in the bag.

The bag of the invention is also provided with spike means mounted on the frame for the divider means and adapted to be inserted into the ground to hold the bag in an upright position. Prior art golf bag supports are shown in U.S. Pat. Nos. 3,570,795; 3,593,766; 3,603,540; and 3,666,221. The spike means of the invention is distinguishable over the prior art by reason of the provision of a sleeve which provides a protective shield between the shoe of the user and the spike means as will be described more fully hereafter.

DETAILED DESCRIPTION OF THE PREFERRED EMBODIMENT

Figure 1:
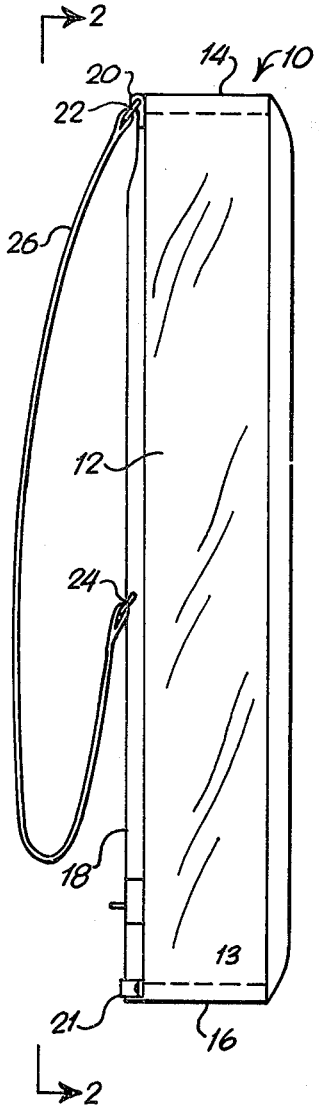
FIG. 1 is a side elevational view of the golf bag in accordance with the invention.

The golf bag of the invention is indicated generally at 10 and comprises a tubular shell means 12 made of a flexible, lightweight material, such as vinyl cloth. Shell means 12 is mounted in a rigid framework comprising a ring-shaped upper frame member 14 and a ring-shaped lower frame member 16 and a connecting frame means in the form of a hollow tubular member 18 extending the length of shell means 12 between frame members 14 and 16. The upper end of tubular member 18 is flattened and is secured, by rivets, to a bent over metal strip 20 which extends upwardly therefrom. The lower end of tubular member 18 is secured, as by welding, to a bracket 21 which is, in turn, secured to a lower frame member 16 by rivets. The lower end of shell means 12 is closed by a bottom 13 mounted within lower frame member 16. By this arrangement, upper and lower frame members 14 and 16 and tubular member 18 provide a rigid frame construction cooperating with shell means 12 to provide an elongated enclosure for receiving and holding the shafts of golf clubs, the enclosure having an open top end through which the golf clubs shafts are inserted into shell means 12.

Strip 20 is secured to upper frame member 14 by riveting and is formed to receive an upper strap clip 22. A lower strap clip 24 is mounted at a medial portion of tubular member 18. A conventional carrier strap 26 is connected at its ends to clips 22 and 24 as is shown in FIG. 1.

In accordance with the invention, there is provided means within the shell enclosure providing a plurality of separate compartments for receiving and holding golf club shafts in a predetermined separated position in golf bag 10. Such compartment providing means includes a honeycomb-shaped divider means indicated generally at 30 and shown in detail in FIGS. 3A, 3B and 4. Divider means 30 consists of a framework of a flexible, lightweight, cloth-like material constructed and arranged to define a plurality of hexagonal-shaped compartments extending the length of the shell enclosure. As will be described more fully hereafter, divider means 30 is connected to upper and lower frame members 14 and 16 at a plurality of circumferentially spaced locations to retain the same in a fixed position within the shell enclosure. To this end, upper and lower frame members 14 and 16 are shaped similarly in the form of hexagons.

Divider means 30 is constructed and arranged to provide compartments for a full set of fourteen golf clubs. As is indicated in FIG. 3B, there are compartments for four woods (Numbers 1, 3, 4 and 5), eight irons (numbers 2–9), a wedge and a putter. Divider means 30 is connected to the upper and lower frame members 14 and 16 at a plurality of circumferentially spaced locations to thereby retain the clothlike framework in position within the shell enclosure, these connections being made by a nylon cord or the like tied to the frame members 14 and 16 and engaged with divider means 30 at exterior vertexes indicated at 31–46 in FIG. 3A. The connection between divider means 30 and the upper and lower frame members 14 and 16 is the same as shown in detail with respect to upper frame member 14 in FIG. 3A.

Divider means 30 consists of six cloth pieces; namely, a first cloth piece 51 extending in a honeycombed configuration from a first side 61 of upper and lower frame members 14 and 16 to a second side 62 thereof and back to first side 61, cloth piece 51 being secured to each first side 61 at vertex 32 and to each second side 62 at vertex 39; a second cloth piece 52 extending in a honeycombed configuration from side 61 of upper and lower frame members 14 and 16 to second side 62 thereof and back to first side 61, cloth piece 52 being secured to each first side 61 at vertex 31 and to each second side 62 at vertex 40; a third cloth piece 53 extending in a honeycombed configuration from a third side 63 of upper and lower frame member 14 and 16 to a fourth side 64 thereof adjacent side 63, cloth piece 53 having end portions secured to each of sides 63 and 64 at vertexes 33 and 38, respectively, and having medial portions secured to each of sides 63 and 64 at vertexes 34 and 37, respectively; a fourth cloth piece 54 extending in a honeycombed configuration from a fifth side 65 of upper and lower frame members 14 and 16 to a sixth side 66 thereof adjacent side 65, cloth piece 54 having end portions secured to each of sides 65 and 66 at vertexes 46 and 41, respectively, and medial portions secured to each of sides 65 and 66 at vertexes 45 and 42, respectively; a fifth cloth piece 55 extending from each third side 63 of upper and lower frame members 14 and 16 to each fourth side 64 thereof, cloth piece 55 having end portions secured to each of sides 63 and 64 at vertexes 34 and 37, respectively, and medial portions secured to each of sides 63 and 64 at vertexes 35 and 36, respectively; and a sixth cloth piece 56 extending from each fifth side 65 of upper and lower frame members 14 and 16 to each side 66 thereof, cloth piece 56 having end portions secured to each of sides 65 and 66 at vertexes 45 and 42, respectively, and medial portions secured to each of sides 65 and 66 at vertexes 44 and 43 respectively.

As is shown in FIG. 3B, first cloth portion 51 is joined together with second cloth portion 52 by sewing at common vertexes, cloth portions 51 and 52 being constructed and arranged to define eight hexagonal-shaped compartments; namely, the compartments for the Number 1 wood, the Number 3 wood, the Number 5 wood, the Number 4 iron, the Number 5 iron, the Number 8 iron, the wedge and the putter.

The third cloth piece 53 is joined to first cloth piece 51 by sewing at common vertexes and fourth cloth piece 54 is joined to second cloth piece 52 by sewing at common vertexes. Accordingly, third cloth piece 53 and fourth cloth piece 54 cooperate with first cloth piece 51 and second cloth piece 52 to define four hexagonal-shaped compartments; namely, the compartments for the Number 4 wood, the Number 2 iron, the Number 7 iron, and the Number 9 iron.

Fifth cloth piece 55 is joined with third cloth piece 53 at common vertexes to cooperate therewith to define the hexagonal-shaped compartment for the Number 3 iron. Sixth cloth piece 56 is joined with fourth cloth piece 54 at common vettexes to cooperate therewith to define the hexagonal-shaped compartment for the Number 6 iron.

Figure 3A:
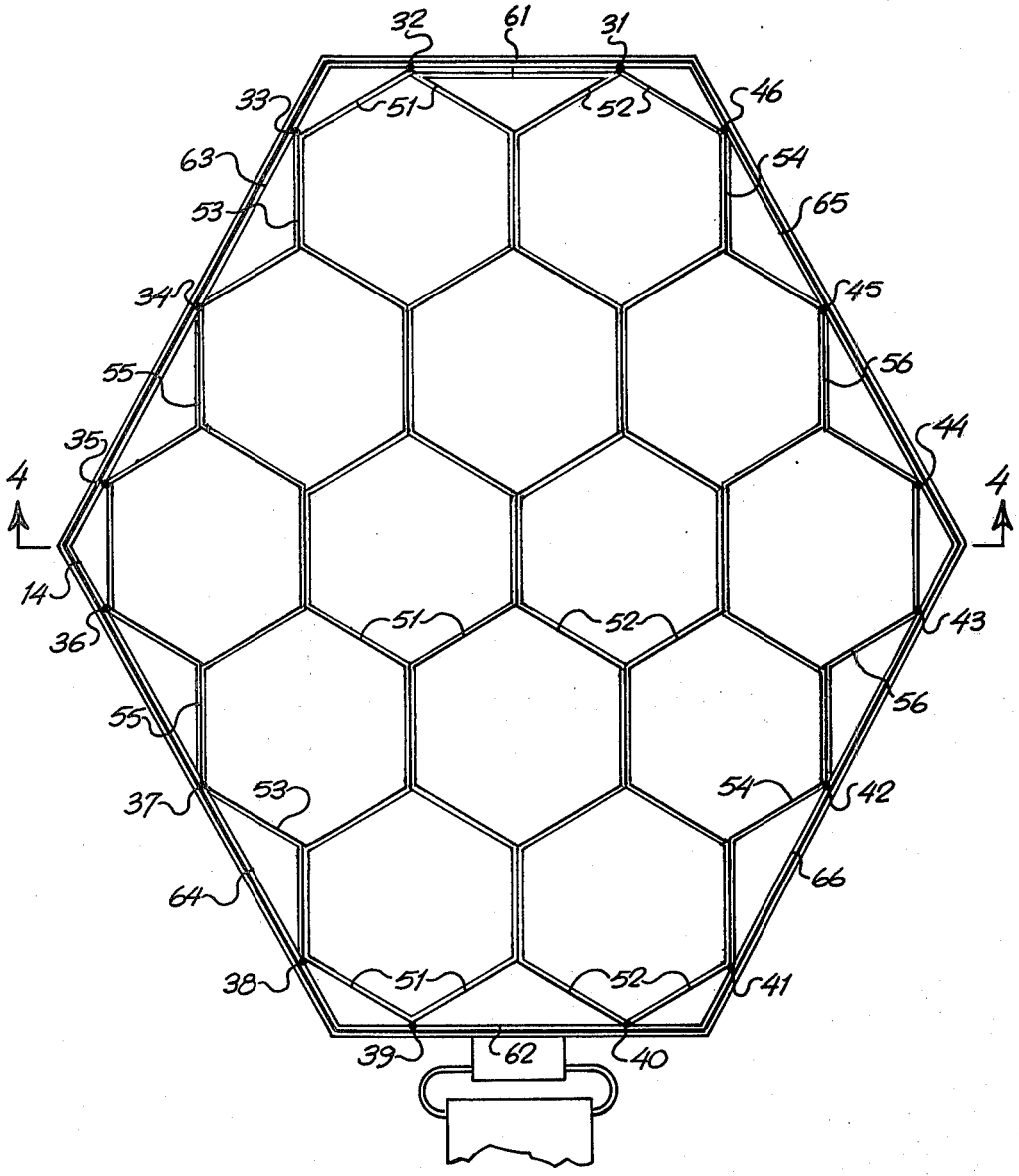
FIG. 3A is an enlarged top plan view of the golf bag shown in FIG. 2.
Figure 3B:
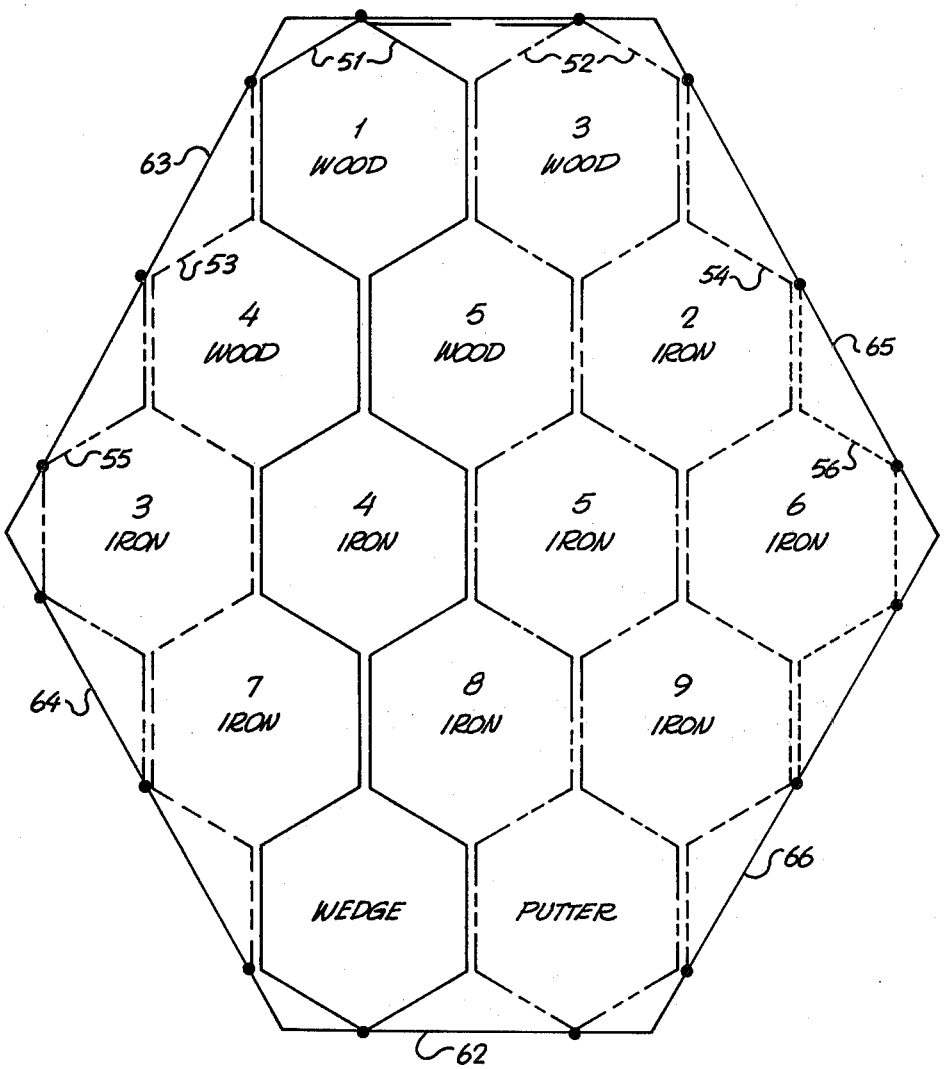
FIG. 3B is a diagrammatic view similar to FIG. 3A showing the honeycomb-shaped divider means.

As is shown in FIG. 3A, the vertexes of all the hexagonal compartments, except the external vertexes of the compartments for the Number 3 iron and the Number 6 iron have double layers of cloth pieces secured together by sewing. This provides a very strong structure for divider means 30.

Figure 4:
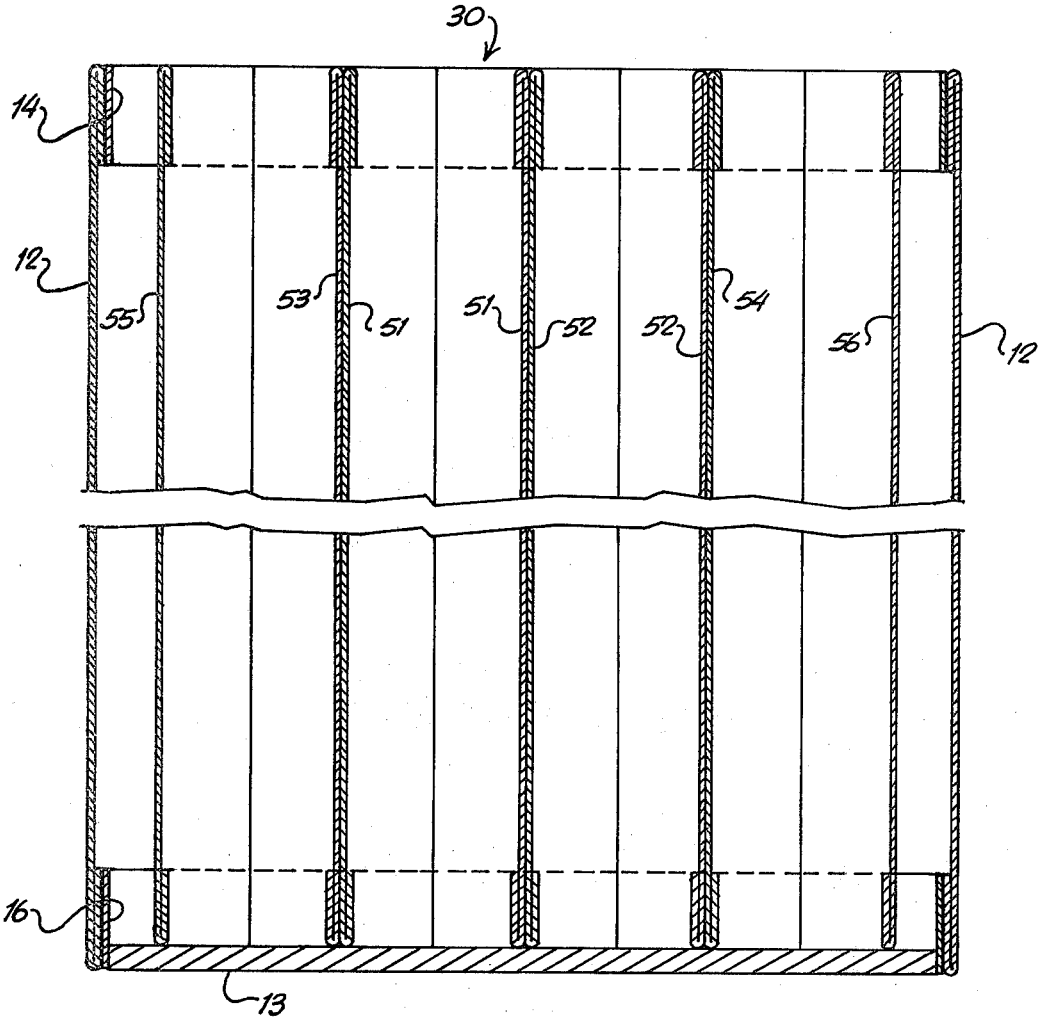
FIG. 4 is a sectional view taken on line 4—4 of FIG. 3A.

As is shown in FIG. 4, the upper and lower ends of cloth pieces 51 to 56 are overlapped. This construction improves the wear resistance of the honeycombed cloth framework forming divider means 30.

Figure 2:
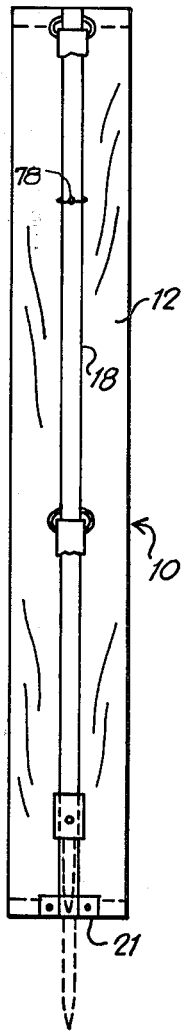
FIG. 2 is an elevational view taken on line 2—2 of FIG. 1.
Figure 5:
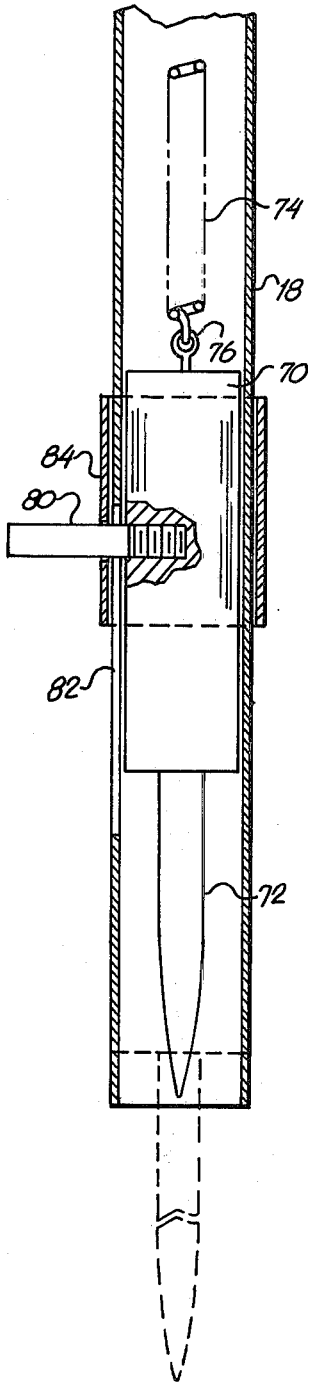
FIG. 5 is a fragmentary sectional view showing the spike means for holding the golf bag in an upright position.

In accordance with another feature of the invention, golf bag 10 is provided with spike means adapted to be inserted into the ground to hold the golf bag in an upright position. To this end, tubular member 18 is open at its bottom end, and contains a spike means slidable within the interior thereof. The spike means comprises a cylindrical member 70 having a reduced diameter portion 72 shaped to form a spike having a pointed end at the open end of the tubular member 18. The spike means is movable between a retracted position shown in solid lines in FIG. 5 and an extended position shown in dashed lines in FIGS. 2 and 5. In the extended position of the spike means, the portion 72 forming the spike projects beyond the lower end of tubular member 18 for insertion into the ground.

Means are provided for biasing the spike means to the retracted position. Such means comprises a spring 74 connected in tension between an eyelet 76 secured to the upper end of the cylindrical member 70 and an upper portion of tubular member 18, the upper end of spring 74 extending through an opening 78 in tubular member 18 for connection thereto.

A foot operable actuating means is provided for actuating the spike means from the retracted position to the extended position and comprises a rod 80 threadedly engaged in cylindrical member 70 to extend laterally therefrom through an elongated slot 82 in tubular member 18. A sleeve 84 is slidably mounted on the exterior of tubular member 18 and is secured to rod 80 which extends through an opening in sleeve 84. Sleeve 84 extends upwardly from rod 80 a substantial distance to provide a protective shield between the shoe of the user and tubular member 18. By this construction, the shoe of the user does not rub against any part of tubular member 18 during a spike inserting movement to thereby prevent tearing or other damage to the shoe.

In use, the golfer places the golf bag in an upright position on the ground and applies a downward pressure by means of his foot onto rod 80 to force the spike portion 72 into the ground. This will hold the bag in an upright position. When the golfer is ready to move on from the place where the golf bag is positioned, he simply picks up the golf bag in the normal manner and moves on. Once the spike portion 72 is removed from the ground, spring 74 causes the same to return to the retracted position whereby there is no danger of causing injury to the golfer as the golf bag is carried on.

What is claimed is:

1. A golf bag comprising a shell means defining an elongated enclosure for receiving and holding the shafts of golf clubs, said enclosure having an open top end through which the golf clubs are inserted into said shell means, means within said enclosure providing a plurality of separate compartments for receiving and holding the golf club shafts in a predetermined separated position in the golf bag, said compartment providing means including a honeycomb-shaped divider means providing a plurality of compartments having open top ends located at the top end of said enclosure for receiving the golf club shafts inserted into said compartments, said divider means comprising a framework of cloth-like material, said framework of cloth-like material being constructed and arranged to define a plurality of hexagonal-shaped compartments extending the length of said enclosure, an upper frame member located at the top end of said enclosure, a lower frame member located at the bottom end of said enclosure; and a connecting frame means extending along the length of said shell means between said upper and lower frame members to hold said upper and lower frame members in a spaced apart location, said upper and lower frame members and said connecting frame means providing a rigid construction and cooperating with said shell means to maintain the shape of said elongated enclosure, said upper and lower frame members having a ring-like shape, said upper frame member extending around the open top end of said enclosure, said divider framework being connected to said upper and lower frame members at a plurality of circumferentially spaced locations thereon to retain said divider framework in position within said enclosure.

2. The golf bag according to claim 1 wherein said upper and lower frame members have a similar hexagonal shape, said divider framework being connected to said upper and lower frame members at external vertexes of said divider framework.

3. A golf bag according to claim 2 wherein internal vertexes of said hexagonal compartments have double layers of said cloth-like material secured together at each of said internal vertexes.

4. A golf bag according to claim 3 wherein said divider framework is made up of a plurality of pieces of said cloth-like material, first and second cloth pieces extending from a first side of each of said upper and lower frame members to a second side thereof opposite said first side and back to said first side and being secured to said first and second sides.

5. A golf bag according to claim 4 wherein said first and second cloth pieces are joined together at common internal vertexes and being constructed and arranged to define eight hexagonal-shaped compartments.

6. A golf bag according to claim 5 including a third cloth piece extending from a third side of each of said upper and lower frame members to a fourth side thereof adjacent said third side and having end portions secured to said third and fourth sides, said third cloth piece being joined to said first cloth piece at common vertexes, and a fourth cloth piece extending from a fifth side of said upper and lower frame members to a sixth side thereof adjacent said fifth side and having end portions secured to said fifth and sixth sides, said fourth cloth portion being joined to said second cloth piece at common vertexes, said third and fourth cloth pieces cooperating with said first and second cloth pieces to define four hexagonal-shaped compartments.

7. A golf bag according to claim 6 including a fifth cloth piece extending from said third side of each of said upper and lower frame members to said fourth side therof and having end portions secured to said third and fourth sides, said fifth cloth piece being joined to said third cloth piece at common vertexes, and a sixth cloth piece extending from said fifth side of each of said upper and lower frame members to said sixth side thereof and having end portions secured to said fifth and sixth sides, said sith cloth piece being joined to said fourth cloth piece at common vertexes, said fifth cloth piece cooperating with said third cloth piece to define one hexagonal-shaped compartment, and said sixth cloth piece cooperating with said fourth cloth piece to define one hexagonal-shaped compartment.

8. A golf bag according to claim 1 wherein said connecting frame means comprises a tubular member having a spike means slidably mounted therein and moveable from a retracted position within said tubular member to an extended position projecting beneath the bottom of said shell means for insertion into the ground to hold the golf bag in an upright position, a foot operable actuating means secured to said spike means and projecting through a slot in said tubular member, and a sleeve slidably mounted on the exterior of said tubular member and secured to said foot actuating means for movement therewith.

9. A golf bag according to claim 8 including means for biasing said spike means to said retracted position, said foot operable actuating member projecting through an opening in said sleeve, and said sleeve extending upwardly from said opening a substantial distance to provide a protective shield between the shoe of the user and said tubular member.

10. A golf bag comprising a shell means defining an elongated enclosure for receiving and holding the shafts of golf clubs, said enclosure having an open top end through which the golf clubs are inserted into said shell means, and means within said enclosure providing a plurality of separate compartments for receiving and holding the golf club shafts in a predetermined separated position in the golf bag, said compartment providing means including a honeycomb-shaped divider means providing a plurality of compartments having open top ends located at the top end of said enclosure for receiving the golf club shafts inserted into said compartments, said divider means comprising a framework of cloth-like material, said framework of cloth-like material being constructed and arranged to define a plurality of hexagonal-shaped compartments extending the length of said enclosure, and the internal vertexes of said hexagonal compartments having double layers of said cloth-like material secured together at said internal vertexes.

* * * * *